US006127961A

United States Patent [19]

Stacy et al.

[11] Patent Number: 6,127,961

[45] Date of Patent: Oct. 3, 2000

[54] REMOTE CONTROL BRAND CODE IDENTIFICATION SYSTEM AND METHOD

[75] Inventors: Carl W. Stacy, Elmwood Park; Gary Steimle, Vernon Hills, both of Ill.

[73] Assignee: Zenith Electronics Corporation, Glenview, Ill.

[21] Appl. No.: 09/098,115

[22] Filed: Jun. 16, 1998

[51] Int. Cl.[7] ..... G08C 19/12

[52] U.S. Cl. ..... 341/176; 341/173; 340/825.69; 348/734

[58] Field of Search ..... 341/176, 173; 340/825.69, 825.72, 825.31; 348/734

[56] References Cited

U.S. PATENT DOCUMENTS 4,959,810 9/1990 Darbee ..... 340/825.69

5,661,804 8/1997 Dykema ..... 380/21

5,831,555 11/1998 Yu ..... 341/26

5,883,680 3/1999 Nykerk ..... 348/734

*Primary Examiner*—Michael Horabik

*Assistant Examiner*—Albert K. Wong

[57] ABSTRACT

A multi brand remote control transmitter includes a programmable memory for configuring the transmitter to transmit the IR control codes for a plurality of controllable devices of different manufacturers, each of which is identified by series of digits. Provision is made for recovering the series of digits from the programmed transmitter by a series of keyboard operations. The digits are read out by flashing an LED that corresponds to the controllable device.

8 Claims, 2 Drawing Sheets

REMOTE CONTROL BRAND CODE IDENTIFICATION SYSTEM AND METHOD

BACKGROUND OF THE INVENTION AND PRIOR ART

This invention relates generally to multi brand, multi device remote control transmitters and specifically to a method of recovering the various brand codes for which the transmitter is programmed.

Remote control transmitters of the above type include programmable memories that have control signal code information for a variety of controllable devices from a plurality of manufacturers stored therein. The controllable devices, i. e., the devices that the transmitter can contro, are generally a television receiver, a VCR, a cable box and one or more auxiliary devices, such as a CD player. The various devices (which correspond to the various transmitter operating modes) are selected by a switch arrangement on the transmitter, with an indication of the selected transmitter operating mode being given to the user in the form of illumination of an LED. The user is provided with a listing of manufacturers for the various devices that identifies one or more brand code sequences for accessing the transmitter's programmable memory to configure it to transmit the appropriate control codes for the selected device. The brand code sequences usually comprise three digits. Programming is accomplished by entering a programming mode, keying in a brand code sequence and testing the transmitter to see if the selected device responds to the transmitted control code. In many instances, more than one brand code sequence is listed for a manufacturer and the process of finding the correct brand code is often tedious.

Some transmitters have an Auto Find feature, in which a brand code is not entered, but rather a series of power commands is used until the selected device responds to the transmitter code. Multi brand, multi device remote control transmitters have been in use for a number of years and have greatly contributed to the reduction of clutter and confusion that often results when a number of remote control transmitters is required to control various consumer products that are located in the same room.

There are often times when it is desired to know the brand code that is programmed into a remote control transmitter. Since the brand codes can be changed, failure of a device to respond to a transmitter may be due a failure of the transmitter, failure of the device's control signal receiver or a wrong brand code programmed into the transmitter. In some transmitters that have an LED display, the programmed brand code may be shown on the LED display when the brand code is read out. The present invention enables read out of the programmed brand code in a transmitter that does not have an LED or equivalent type display.

OBJECTS OF THE INVENTION

A principal object of the invention is to provide a novel multi brand, multi device remote control transmitter.

Another object of the invention is to provide a method and apparatus for reading out a programmed brand code in a remote control transmitter.

A further object of the invention is to provide a method and apparatus for reading out a programmed brand code in a remote control transmitter that does not have a digit display.

BRIEF DESCRIPTION OF THE DRAWINGS

These and other objects and advantages of the invention will be apparent upon reading the following description in conjunction with the drawings in which.

DESCRIPTION OF THE PREFERRED EMBODIMENT

Figure 1:
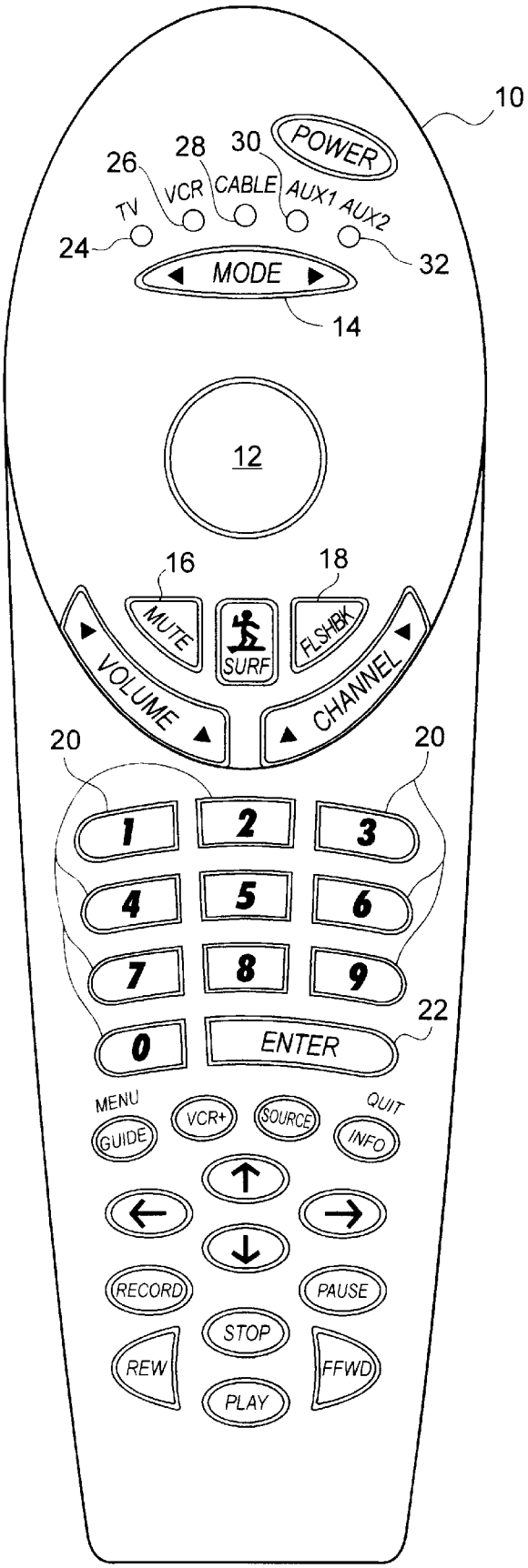
FIG. 1 is a plan view of a remote control transmitter for performing the method of the invention.

Referring to FIG. 1 of the drawings, there is shown a remote control transmitter 10 constructed in accordance with the invention. A trackball 12 is used to control an onscreen cursor for selecting and operating some of the functions of a television receiver. A mode switch 14 is used to switch the transmitter between its various operating modes for enabling control of various consumer product devices. A mute key 16 and a flashback key 18 are used to mute the audio and to switch back to the previously viewed channel in the television mode, respectively. A plurality of keys 20 correspond to the digits 0 through 1 and an Enter key 22 is used to signify the termination of a command, and is also used in various programming operations. Other keys are included, but have no relevance to the present invention. All of the keys are collectively referred to as a keyboard even though they may not be physically close to each other. Positioned above mode switch 14 is a plurality of LEDs 24, 26, 28, 30 and 32, labelled respectively as TV, VCR, CABLE, AUX 1 and AUX 2. As operation of the mode switch sequentially changes the operating mode of the transmitter, the corresponding one of the LEDs is illuminated to indicate the selected mode.

Figure 2:
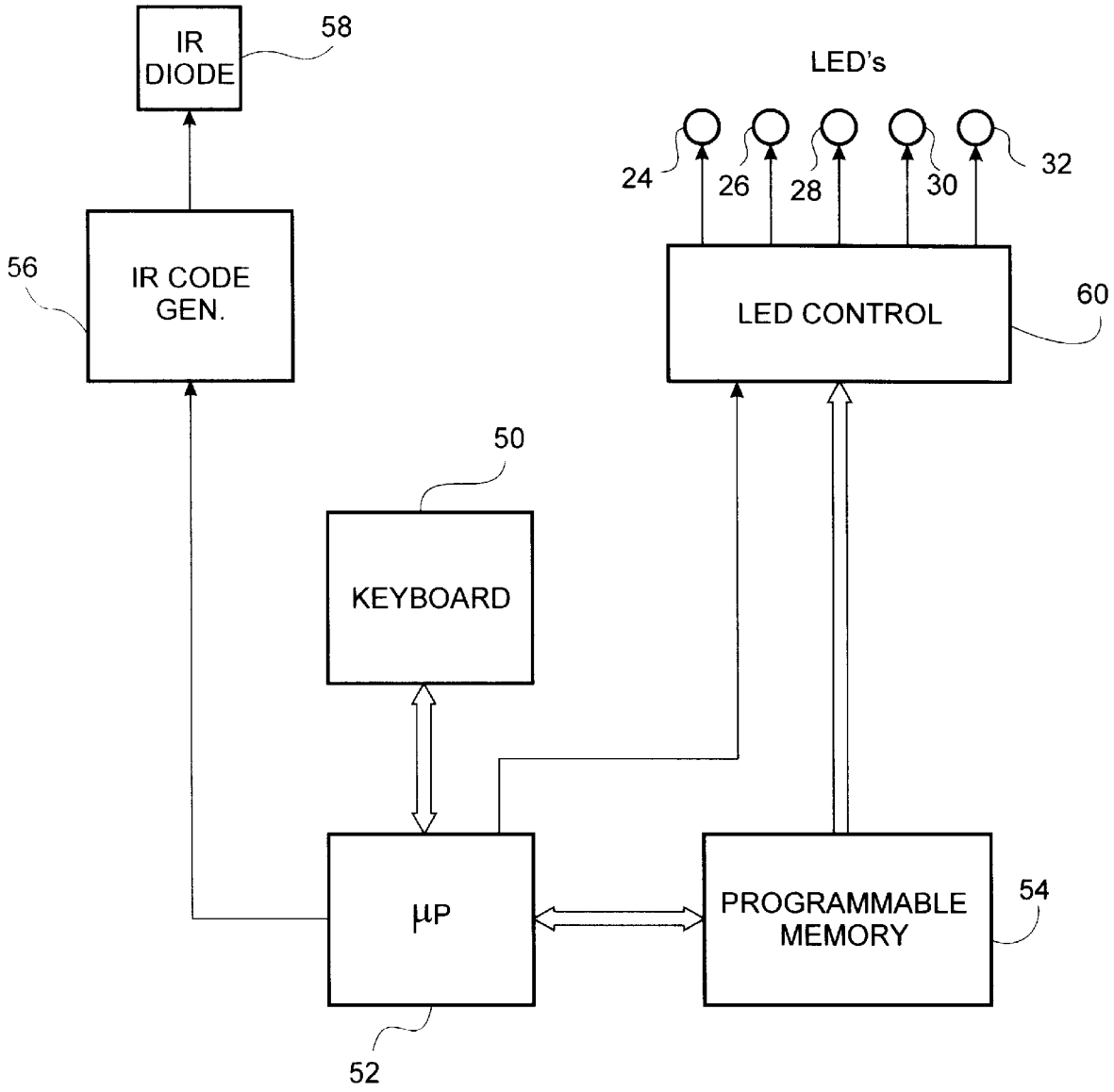
FIG. 2 is a simplified functional diagram of a remote control transmitter operating in accordance with the method of the invention.

FIG. 2 is a simplified functional block diagram of transmitter 10. A key board 50 is controlled by a microprocessor 52 that is in communication with a programmable memory 54 in which the data required for generating the control codes for the various brands of devices is stored. The memory is well-known in the art, as is the keyboard and microprocessor and their method of operation, for programming the transmitter to transmit the appropriate control codes in response to the input of the brand code sequences, in a programming mode of the transmitter. An IR code generator 56 is controlled by microprocessor 52 to cause an IR diode 58 to transmit the control codes. An LED control 60 operates under control of microprocessor 52 and programmable memory 54 to selectively illuminate the LEDs 24–32 in accordance with mode selection of the transmitter.

The LEDs are used in the invention to read out the brand codes that have been programmed into programmable memory 54 by a user when the transmitter is placed in its programming mode by appropriate operation of selected keys of the keyboard. The sequence of key operations may vary depending upon the system design and the invention is not to be limited to the disclosed arrangement.

In the preferred embodiment, read out of a programmed brand code is accomplished as follows:

(a) The programming mode of the transmitter is entered by simultaneously depressing the MUTE key 16 and the FLASHBACK key 18 for about three seconds until the LED for the current device or mode is illuminated.

(b) The digit keys 9; 2, 2 are sequentially operated followed by operation of the ENTER key 22. The current mode LED will flash three times to indicate that the transmitter is ready to identify the brand code.

(c) If the current mode is not the desired one, the MODE key 14 is depressed (left or right) until the LED corresponding to the mode for which the brand code is desired, is selected.

(d) The ENTER key 22 is depressed. After a delay of about one second, the selected LED flashes a number of times corresponding to the first digit of the brand code.

(e) After another one second delay, the selected LED flashes the number of times corresponding to the second digit of the brand code.

(f) After another one second delay, the selected LED flashes the number of times corresponding to the third digit of the three digit brand code.

(g) The LED turns off and the transmitter returns to the normal operating mode.

The LED flashes are in groupings, corresponding to each of the digits and the flashes occur at a substantially constant rate. To indicate a zero, the LED is flashed at a faster rate for a short time.

Should the brand code for a different device be desired, the above procedure is repeated except that the LED corresponding to the different device is selected in (c) above.

What has been described is a novel method and apparatus for identifying the brand code programmed into a multi brand, multi device remote control transmitter. It is recognized that numerous changes to the described embodiment of the invention will be apparent without departing from its true spirit and scope. The invention is to be limited only as defined in the claims.

What is claimed is:

1. A method of identifying the brand code programmed into a remote control transmitter, the transmitter including an LED for each of a plurality of different types of remotely controllable devices comprising:

entering the programming mode of the remote control transmitter;

initiating the read out of the brand code programmed into the remote control transmitter for a selected one of the types of different remotely controllable devices; and flashing the corresponding one of the LEDs in groupings corresponding to the digits of the programmed brand code.

2. The method of claim 1, further comprising introducing a predetermined delay between the groupings.

3. The method of claim 2, further comprising flashing at a substantially constant rate for the digits 1 through 9 and flashing at a faster rate to indicate a zero.

4. The method of claim 1, wherein the initiating step further comprises:

simultaneously depressing a pair of selected keys on the remote control keyboard until one of the LEDs is illuminated;

performing a predetermined sequence of key operations to enter the programming mode; and performing further key operations to select the LED corresponding to the desired remotely controllable device and to initiate brand code readout.

5. A programmable remote control transmitter including a plurality of keys comprising:

memory means for storing command codes for a plurality of remotely controllable devices, said memory means being programmable in a programming mode in response to the input of a series of brand identification code digits from corresponding ones of said keys;

a plurality of LEDs for identifying each of said plurality of different types of remotely controllable devices;

means for activating a corresponding one of said LEDs in a read out mode to read out the programmed brand identification code digits that have been programmed in said remote control transmitter for the selected one of said remotely controllable devices; and said corresponding LED being flashed in groupings to identify the digits of said programmed brand identification code.

6. The control transmitter of claim 5, wherein selective operation of certain of said keys accesses said programming mode.

7. The control transmitter of claim 6, wherein said transmitter includes:

mode means for selecting a desired one of said remotely controllable devices, a corresponding one of said LEDs being illuminated to indicate the selected device.

8. The control transmitter of claim 7, wherein said corresponding LED is flashed at a substantially constant rate for the digits 1 through 9 and wherein said corresponding LED is flashed at a faster rate to indicate a zero.

* * * * *